United States Patent [19]

Miller et al.

[11] Patent Number: 4,967,445

[45] Date of Patent: Nov. 6, 1990

[54] INTERIOR WINDOW HANDLE

[75] Inventors: Leonard G. Miller, Orchard Lake; Kurt R. Finkbeiner, Warren, both of Mich.

[73] Assignee: Molmec, Inc., Walled Lake, Mich.

[21] Appl. No.: 181,693

[22] Filed: Oct. 11, 1988

[51] Int. Cl.[5] ..... B25G 3/00; G05G 1/00

[52] U.S. Cl. ..... 16/121; 74/545

[58] Field of Search ..... 16/121, 118, DIG. 24, 16/DIG. 30; 74/545

[56] References Cited

U.S. PATENT DOCUMENTS 4,052,768 10/1977 Yamazaki et al. ..... 16/121
4,821,597 4/1989 Marciniak et al. ..... 16/121

FOREIGN PATENT DOCUMENTS 2218505 10/1973 Fed. Rep. of Germany ..... 74/545
2817127 11/1978 Fed. Rep. of Germany ..... 74/545
2928400 2/1981 Fed. Rep. of Germany ..... 74/545
2087323 5/1982 United Kingdom ..... 74/545

*Primary Examiner*—Richard K. Seidel
*Assistant Examiner*—Carmine Cuda
*Attorney, Agent, or Firm*—Reising, Ethington, Barnard, Perry & Milton

[57] ABSTRACT

A window actuating door handle of the type including a knob rotatably mounted on an elongated handle member and wherein the handle member includes a plurality of cylindrically disposed tangs adapted to resiliently engage a corresponding internal cylindrical surface of the knob to support the knob in a non-rattling and rotatable manner upon the elongated handle member.

5 Claims, 2 Drawing Sheets

INTERIOR WINDOW HANDLE

BACKGROUND OF THE INVENTION

The present invention relates to a handle of the type typically disposed in the passenger compartment of an automobile for manual operation of the vehicle window. More specifically, the handle includes an elongated body portion connected at one end to the window actuating mechanism and at the other end rotatably supporting a knob adapted to be grasped by the window operator.

The basic problem with such a handle construction is sometimes referred to as "torque and rattle". In other words, it is desired that the handle be constructed in such a way that the knob does not rattle without, at the same time, creating too much torque resistance to knob rotation. The present invention is directed to the solution of this problem.

PRIOR ART

There are numerous prior art patents relating to the general construction of interior window handles. The following patents are generally relevant to the subject matter:

1,603,396 Nicholson
2,978,927 Blanton
3,071,023 Herr
3,198,032 Pollak
3,406,590 Popeil
4,052,768 Yamazaki
4,161,891 Bossert
4,534,240 Dietz
WG 2928400

The Yamazaki patent is particularly relevant to applicant's design in that it also includes molded plastic components including an elongated main body member and a knob adapted to be snugly mounted on the body. Applicant's window handle differs from the prior art in several specific and important ways as will be apparent in the description which follows.

DISCLOSURE OF THE INVENTION

The subject invention relates to a handle device of the type including a main body adapted to be operably connected at one end to a vehicle window regulator mechanism. The main body includes a hollow collar projecting upwardly proximate the end of the body opposite from the end adapted to be connected to the window operating mechanism. The knob includes a cylindrical opening having a surface at least a portion of which is engaged by the collar for rotatably supporting the knob. Suitable means is provided to retain the knob upon the main body.

Applicant's specific improvement over the prior art is to form the hollow collar of the body to provide resilient tangs which coact in such a way as to have an interference fit or contact with the internal surface of the knob to prevent the knob from rattling and at the same time to do such without creating undue torque resistance to knob rotation. The interference fit is created by forming either the tang collar or the internal knob surface in a way that the tangs resiliently bias against at least a portion of said surface.

The details of the invention are set forth in the drawings and the description which follow:

BEST MODES FOR CARRYING OUT THE INVENTION

A first form of the invention is represented in FIGS. 1 through 4.

Figure 1:
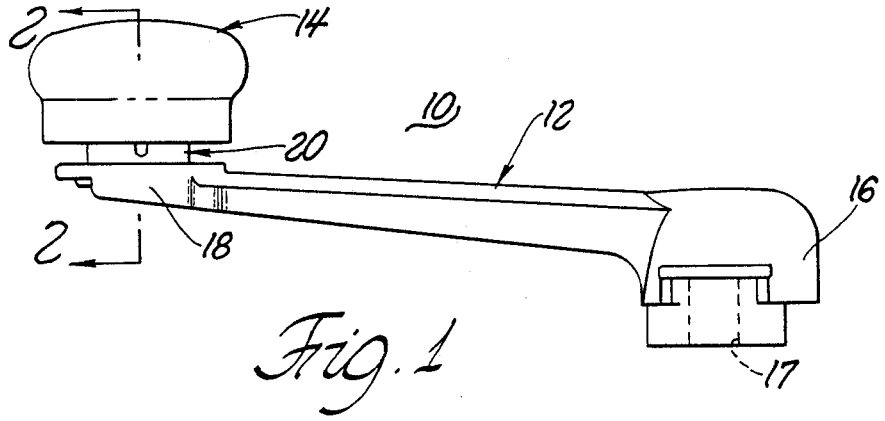
FIG. 1 is a side elevational view of the handle including the knob mounted to the main body portion.

A handle assembly is indicated generally at 10, as shown in FIG. 1, and includes a main body portion 12 and a knob 14. While the main body and knob may be made from any suitable material, it is preferred that they be molded out of plastic. As illustrated and described, the plastic used to mold the handle body portion 12 may be a glass-filled nylon while the knob is typically an acetal.

Figure 3:
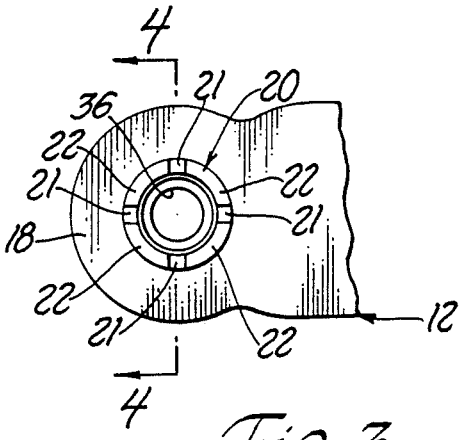
FIG. 3 is a partial plan view of the main body portion with the knob removed.
Figure 4:
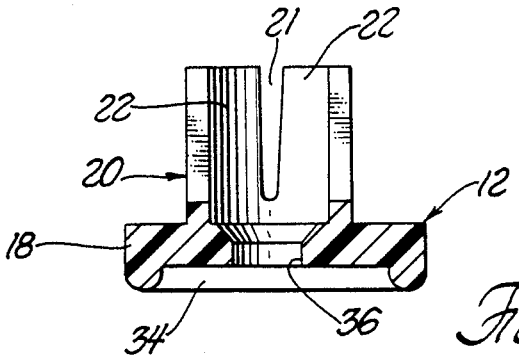
FIG. 4 is a sectional view along lines 4—4 of FIG. 3.

Body portion 12 includes a first end 16 suitably recessed at 17 or otherwise formed to receive a shaft, not shown, of the window operating mechanism. The other end 18 of body portion 12 includes a hollow collar indicated generally at 20 and projecting upwardly therefrom. In the modification shown, collar 20 is a cylindrical tube of constant diameter The collar 20 is slotted at 21, as best seen in FIGS. 3 and 4, to form arcuate or cylindrically disposed tangs 22. To enhance tang flexibility or resilience, slots 21 extend substantially along the height of collar 20 and are open at their upper ends.

Figure 2:
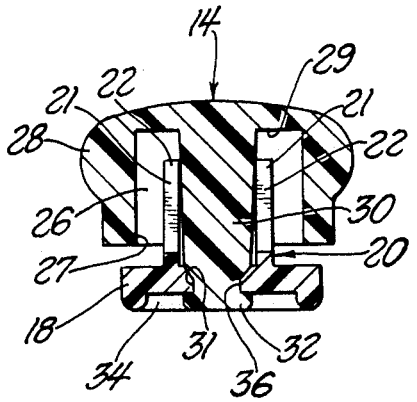
FIG. 2 is the sectional view through the knob and main body along line 2—2 of FIG. 1.

As best seen in FIG. 2, knob 14 includes a cylindrical opening or bore 26 extending inwardly of the knob body 28 and being defined by side and end walls 27 and 29. Stem portion 30 is centrally disposed in the knob and projects downwardly or toward the open end of hollow portion 26. For the purpose of creating an interference with collar tangs 22, stem 30 is tapered from the knob end toward the free end progressing from larger to smaller diameters. Stem 30 tapers in such a way that the diameters beginning at the knob end and progressing from a third to half the length of the stem are larger than the internal diameter of collar 20. The stem taper is such as to create an interference of 0.002 to 0.025 inches between the larger diameter portions of the stem and the adjacent portions of the collar tangs 22 when the knob is assembled upon body collar 20. In the modification of FIGS. 1 through 4, stem 30 is circumferentially recessed at 31 proximate its outermost or free end to provide an annular lip portion 32.

Again as seen in FIG. 2, the taper of stem 30 is such that the diameters super-adjacent the lip forming recess are smaller than the inside collar diameter.

End 18 of handle body portion 12 includes a relieved or counter-sunk portion 34 on the opposite side of the body portion from the upwardly projecting collar 20. As best shown in FIG. 4, handle body portion 12 includes an annular rim 36 disposed intermediate the upwardly projecting collar 20 and the recessed portion 34. Body 12 includes an upwardly and outwardly flared portion or bevel 37 which facilitates passage of lip 32 past annular rim 36. As best seen in FIG. 2, when knob 14 is assembled to body portion 12, depending knob stem 30 projects through the collar 20 such that stem lip 32 and annular rim 36 deform sufficiently to allow the lip to snap beneath the rim and seat within recess 34 to lockingly retain the knob 14 on handle portion 12.

As opposed to coacting cylindrical bearing or support surfaces between the knob and body collar which can initially misfit or become loose with wear, applicant's use of resilient tangs 22, which interferingly engage with knob stem 30, insure an initial and continuing biasing engagement to prevent knob rattle and a light torque resistance to knob rotation.

As an alternative to the tapered stem modification shown, an interference fit between the stem and collar tangs can be created by utilizing a cylindrical stem and an inwardly tapering or conical collar. In such case, the diameters of the upper portion of the tang collar would be smaller than the diameter of the adjacent portion of the knob stem again causing the collar tangs to resiliently bias against the upper portion of the knob stem.

Figure 5:
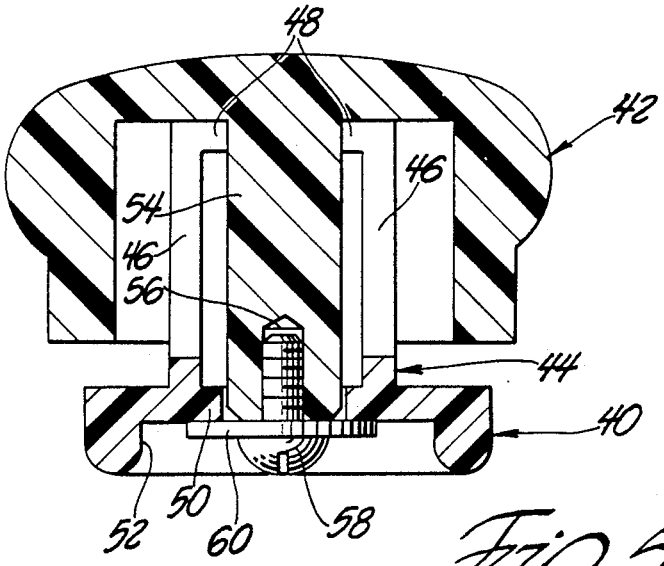
FIG. 5 is a second modification of the invention.

Another modification of the invention is shown in FIG. 5. In this form, handle body 40 is adapted to rotatably support knob 42. Body 40 includes a generally cylindrical upstanding collar 44 again slotted to provide tangs 46. The upper ends of tangs 46 are formed to provide inwardly projecting lips or lugs 48. Body 40 again includes a radially inwardly extending lip 50 and an annular recess 52.

Knob 42 includes centrally depending cylindrical stem 54. In this modification, instead of knob 42 being snapped into engagement with handle body 40 cylindrical stem 54 includes a central axial recess 56 adapted to receive a self-tapping screw or rivet 58 which retains an intermediate washer 60 having a diameter of sufficient size to overlay body lip 50 and thereby retain the knob upon the body.

In this modification, the diameter of cylindrical knob stem 54 is larger than the internal diameter of collars lugs 48. Thus, when the knob is assembled to body 40 cylindrical stem 54 outwardly deflects collar tangs 46 thereby causing the tangs to resiliently bias against the stem to maintain the knob in a non-rattling relationship to body 40. The internal diameter of body lip 50 should be slightly larger than the diameter of stem 54.

Figure 6:
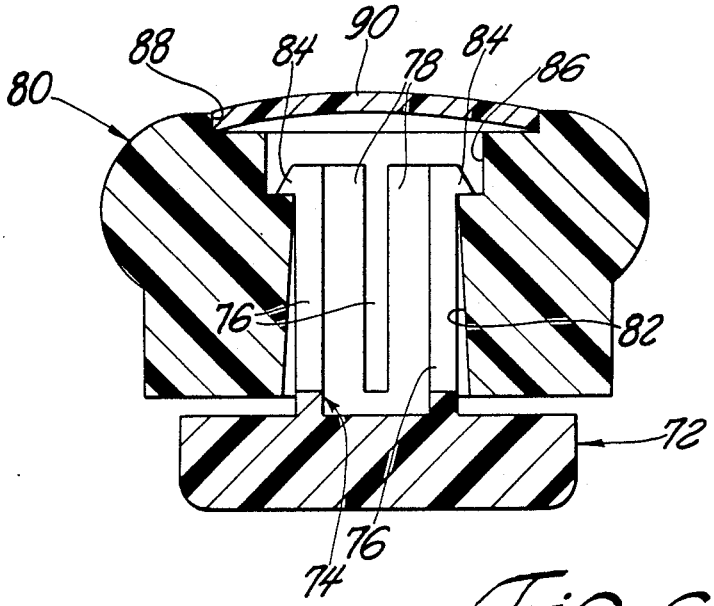
FIG. 6 is a third modification of the invention.

A third modification of the invention is depicted in FIG. 6. The operating handle body includes an outer end 72. Collar 74 projects upwardly from body end 72 and again includes diametrical slots 76 to form resilient collar tangs 78.

A knob is indicated at 80 and includes a central through bore 82 tapering inwardly from its lower end whereby the upper third of the bore has diameters smaller than the external diameter of the cylindrical collar 74, thus, creating an interference fit between the collar tangs 78 and the knob bore 82. Again, alternatively, knob bore 82 could be molded as a straight cylinder with the interference fit created by an upwardly and outwardly tapered collar 74 which would give an outward flare to the tangs 78 so as to interferingly engage with the upper end of the bore. To snappingly retain knob 80 upon the tang collar 74, the upper ends of the tangs 78 are formed with outwardly projecting lips 84 which snap over the edge formed by counter-bore 86.

In order to enclose the knob interior, a further counter-bore 88 is provided into which a decorative disc or button 90 is wedgingly retained.

Other modifications may be made with the intended scope of the invention as set forth in the hereinafter appended claims.

What is claimed is:

1. A handle device of the type including a main body (12) adapted to be operably connected at one end to a vehicle window regulator mechanism, a hollow collar (20) projecting upwardly proximate the other end of the main body, the central opening of said collar extending through the main body; a knob (14) having a generally cylindrical bore (26), said knob including an integral stem (30) disposed within said cylindrical bore and having a free end projecting axially beyond said cylindrical bore, said collar and said stem having circular cross sections, and means (32 and 36) for rotatably retaining the knob on the body; the improvement in said device comprising:

said collar (20) being cylindrical and having slots (21) which form a plurality of resilient tangs (22) and said stem (30) being tapered progressing from diameters larger than the inside diameter of the collar to diameters smaller than said inside diameter along the stem length toward said free end to provide an interference fit through at least a portion of the axial length of said tangs when said knob is assembled to the main body.

2. A handle device as set forth in claim 1 wherein said slots (21) are open at their upper ends and the taper of said stem (30) is such that the diameters of the upper end of said stem are between 0.002 and 0.025 inches larger than the inside diameter of the collar (20).

3. A handle device of the type including a main body (12) adapted to be operably connected at one end to a vehicle window regulator mechanism, a hollow collar (20) the central opening of said collar extending through the main body; a knob (14) having a generally cylindrical bore (26), said knob including an integral stem (30) disposed within said cylindrical bore and having a free end projecting axially beyond said cylindrical bore, said collar and said stem having circular cross sections, and means (32 and 36) for rotatably retaining the knob on the body; the improvement in said device comprising:

said collar (20) having slots (21) which form a plurality of resilient tangs (22), said slots (21) extending substantially along the height of said collar and being open at the upper end thereof, the upper ends of said tangs (46) including inwardly projecting lips (48), the diameter of said stem being larger than the inner diameter of said lips to provide an interference fit through at least a portion of the axial length of said tangs when said knob is assembled to the main body.

4. A handle device of the type including a main body (12) adapted to be operably connected at one end to a vehicle window regulator mechanism, a hollow collar (20) projecting upwardly proximate the other end of the main body, the central opening of said collar extending through the main body; a knob (14) having a generally cylindrical bore (26), said knob including an integral stem (30) disposed within said cylindrical bore and having a free end projecting axially beyond said cylindrical bore, said collar and said stem having circular cross sections, and means (32 and 36) for rotatably retaining the knob on the body; the improvement in said device comprising:

said collar (20) having slots (21) which form a plurality of resilient tangs (22), the collar (20) having a circumferential inward taper whereby said tangs (22) are radially inwardly biased against knob stem (30) to provide an interference fit through at least a portion of the axial length of said tangs when said knob is assembled to the main body.

5. A handle device of the type including a main body 72 adapted to be operably connected at one end to a vehicle window regulator mechanism, a hollow collar (74) projecting upwardly proximate the other end of the main body; a knob (80) having a generally cylindrical bore (82); and means (84 and 86) for rotatably retaining the knob on the body; the improvement in said device comprising:

said collar (74) having slots (76) which form a plurality of resilient tangs (78), a bore (82) extending completely axially through the knob (80) and terminating at one end in a pair of super adjacent counter-bores (86 and 88), the knob retaining means including radially projecting lips (84) formed at the upper ends of said tangs, said lips having a larger radial dimension than said knob bore diameter, said lips adapted to extend within the first counter-bore (86) to lockingly retain the knob upon collar (74); and a disc (80) frictionally retained in the second counter-bore (88).

* * * * *